US007950893B2

(12) United States Patent
Rican et al.

(10) Patent No.: US 7,950,893 B2
(45) Date of Patent: May 31, 2011

(54) DEVICE FOR HANDLING MANUFACTURING RINGS, A FORKLIFT INCLUDING THE SAME, AND A METHOD OF HANDLING A MANUFACTURING RING

(75) Inventors: Donald O. Rican, Hooper, NE (US); Daniel E. Guhde, Fremont, NE (US); Paul D. Christenson, Omaha, NE (US)

(73) Assignee: Rinker Materials West, LLC, Valley, NV (US)

( * ) Notice: Subject to any disclaimer, the term of this patent is extended or adjusted under 35 U.S.C. 154(b) by 1010 days.

(21) Appl. No.: 11/797,215

(22) Filed: May 1, 2007

(65) Prior Publication Data

US 2008/0271952 A1 Nov. 6, 2008

(51) Int. Cl.
*B66F 9/18* (2006.01)

(52) U.S. Cl. ..... 414/619; 414/785; 414/911; 294/90

(58) Field of Classification Search ..... 414/619, 414/607, 626, 663, 785, 911, 912; 294/90, 294/97

See application file for complete search history.

(56) References Cited

U.S. PATENT DOCUMENTS

| | | | |
|---|---|---|---|
| 735,616 | A | 8/1903 | Stitt |
| 744,583 | A | 11/1903 | Meaders |
| 3,022,551 | A | 2/1962 | Marburg |
| 3,131,961 | A | 5/1964 | Doros |
| 3,132,890 | A | 5/1964 | Beaudet |
| 3,195,751 | A | 7/1965 | Meyers et al. |
| 3,284,125 | A | 11/1966 | Blaske et al. |
| 3,471,049 | A | 10/1969 | Kepler |
| 3,583,753 | A | 6/1971 | McCrory |
| 4,447,085 | A | 5/1984 | Schmid |
| 4,474,400 | A | 10/1984 | Toffolon |
| 5,642,979 | A | 7/1997 | Cullen et al. |
| 6,648,580 | B2 | 11/2003 | Lofgren |
| 2004/0197178 | A1 * | 10/2004 | Osterloh et al. ..... 414/607 |

* cited by examiner

*Primary Examiner* — Saúl J Rodríguez
*Assistant Examiner* — Willie Berry
(74) *Attorney, Agent, or Firm* — Berenato & White, LLC

(57) ABSTRACT

A lifting apparatus for lifting manufacturing rings is provided. The lifting apparatus includes an attachment part having an opening extending therethrough, and a plurality of elongated legs extending from the attachment part. Each of the elongated legs has a slit disposed therein. A plurality of support rods are movably disposed in the slits. The support rods are pivotable between a lowered position in which each support rod extends from the associated slit and a raised position in which each support rod is disposed within the associated slit. The lifting apparatus further includes an actuating part operably associated with the support rods and for moving the support rods between the raised position and the lowered position.

20 Claims, 7 Drawing Sheets

DEVICE FOR HANDLING MANUFACTURING RINGS, A FORKLIFT INCLUDING THE SAME, AND A METHOD OF HANDLING A MANUFACTURING RING

FIELD OF THE INVENTION

The present invention relates to a device for handling a manufacturing ring, a forklift including the same, and a method of handling a manufacturing ring.

BACKGROUND OF THE INVENTION

Manufacturing rings, for example headers and pallets, are used to manufacture lengths of pre-cast concrete pipe segments. These manufacturing rings are typically made of a heavy duty metal, such as cast iron. There is an upper ring and a lower ring between which a forum extends into which the concrete is poured. After the concrete is cured, the rings are removed so the pipe may be shipped. The rings may be round. Because concrete pipes range in size and thickness anywhere between 15 inches in diameter and 150 inches in diameter, these manufacturing rings tend to be very heavy and are cumbersome to lift and handle.

When handling these manufacturing rings, several workmen are typically required to move one manufacturing ring at a time. This process is costly and inefficient. Additionally, due to the substantial weight of these manufacturing rings, mishandling a manufacturing ring may result in injury to a workman. Furthermore, because of their weight and diameter, the rings may occupy an excessive amount of area.

Accordingly, there is a need for a device and/or method for safely and easily lifting and handling manufacturing rings used for large concrete pipes.

SUMMARY OF THE INVENTION

According to a first aspect of the present invention, a lifting apparatus for lifting manufacturing rings is provided. The lifting apparatus includes an attachment part, and a plurality of elongated legs extending from the attachment part. Each of the elongated legs has a slit disposed therein. A plurality of support rods are movably disposed in the slits. The support rods are pivotable between a lowered position in which each support rod extends from the associated slit and a raised position in which each support rod is upwardly disposed. The lifting apparatus further includes an actuating part operably associated with the support rods and for moving the support rods between the raised position and the lowered position.

According to a second aspect of the present invention, a forklift assembly is provided. The forklift assembly includes a forklift having a vertical mast and a fork extending substantially horizontally from the mast, and a lifting apparatus for lifting manufacturing rings. The lifting apparatus includes an attachment part having an opening through which the fork is disposed, and a plurality of elongated legs extending from the attachment part. Each of the elongated legs has a slit disposed therein. A plurality of support rods are movably disposed in the slits. The support rods are pivotable between a lowered position in which each support rod extends from the associated slit and a raised position in which each support rod is disposed within the associated slit. The lifting apparatus further includes an actuating part operably associated with the support rods and for moving the support rods between the raised position and the lowered position.

According to a third aspect of the present invention, a method of lifting manufacturing rings is provided. The method includes providing a lifting apparatus having a plurality of elongated legs, and each of the legs having a slit disposed therein. A plurality of support rods are movably disposed in the slits. The support rods are pivotable between a lowered position in which each support rod extends from the associated slit and a raised position in which each support rod is disposed within the associated slit. The lifting apparatus further includes an actuator to move the support rods between the raised and lowered positions. The method further includes setting the support rods in the lowered position, inserting the elongated legs in an opening of a manufacturing ring, moving the elongated legs of the lifting apparatus downward in the manufacturing ring such that the support rods contact inner walls of the annular opening and are forced upward thereby until the elongated legs reach a flange portion of the manufacturing ring at which point the support rods are no longer forced upward and are allowed to pivot downward, and moving the elongated legs of the lifting apparatus upward so that the support rods engage the flange portion of the manufacturing ring thereby lifting the manufacturing ring.

DETAILED DESCRIPTION OF THE INVENTION

Figure 1:
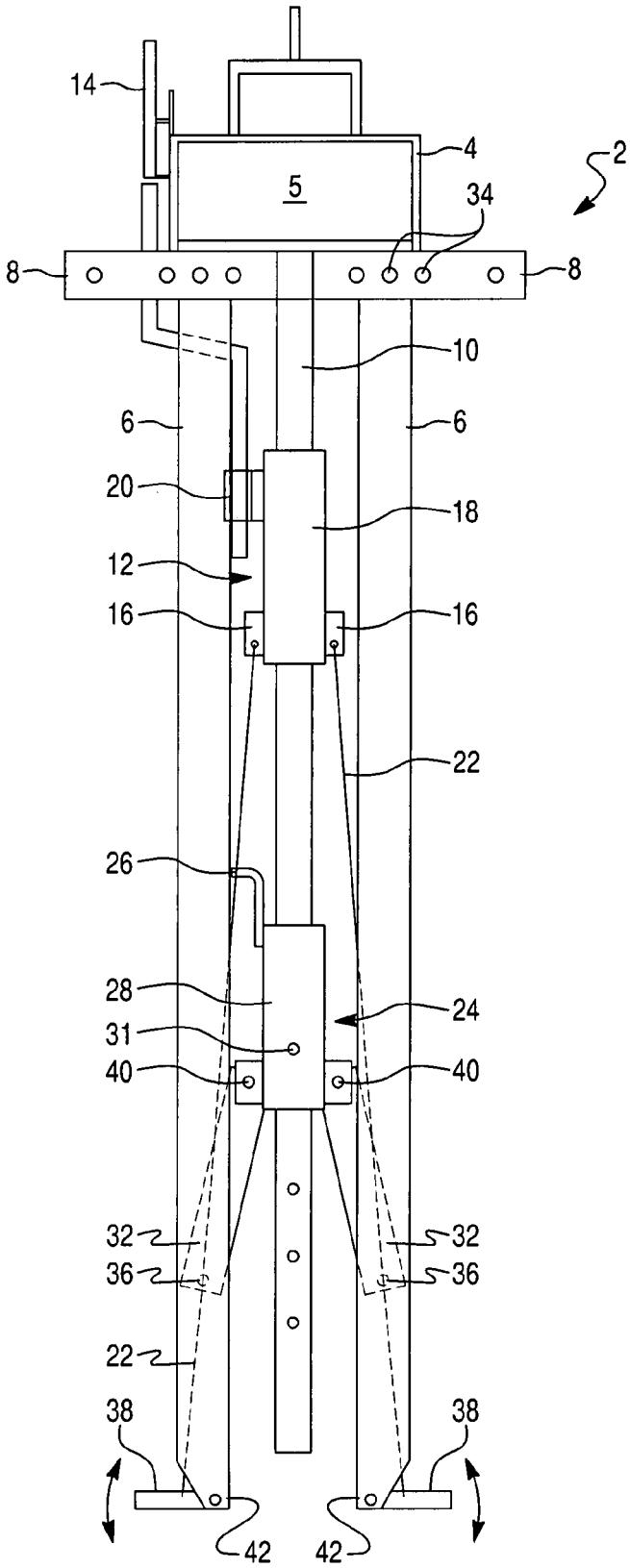
FIG. 1 is an elevational view of a manufacturing ring lifting apparatus according to an embodiment of the present invention.

Reference will now be made in detail to the embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

As best shown in FIG. 1, the lifting apparatus 2 includes an attachment part 4, upper support plates 8 attached to the attachment part 4, a plurality of elongated legs 6 extending downwardly from the upper support plates 8, and a plurality of support rods 38 coupled to the corresponding elongated legs 6 at bottom portions thereof. The lifting apparatus 2 further includes an actuating part 12 that controls the orientation of the support rods 38 with respect to the corresponding elongated legs 6. A width adjusting part 24 adjusts the spacing between the elongated legs 6 such that the lifting apparatus 2 can be used to lift and handle manufacturing rings of different sizes.

Figure 6:
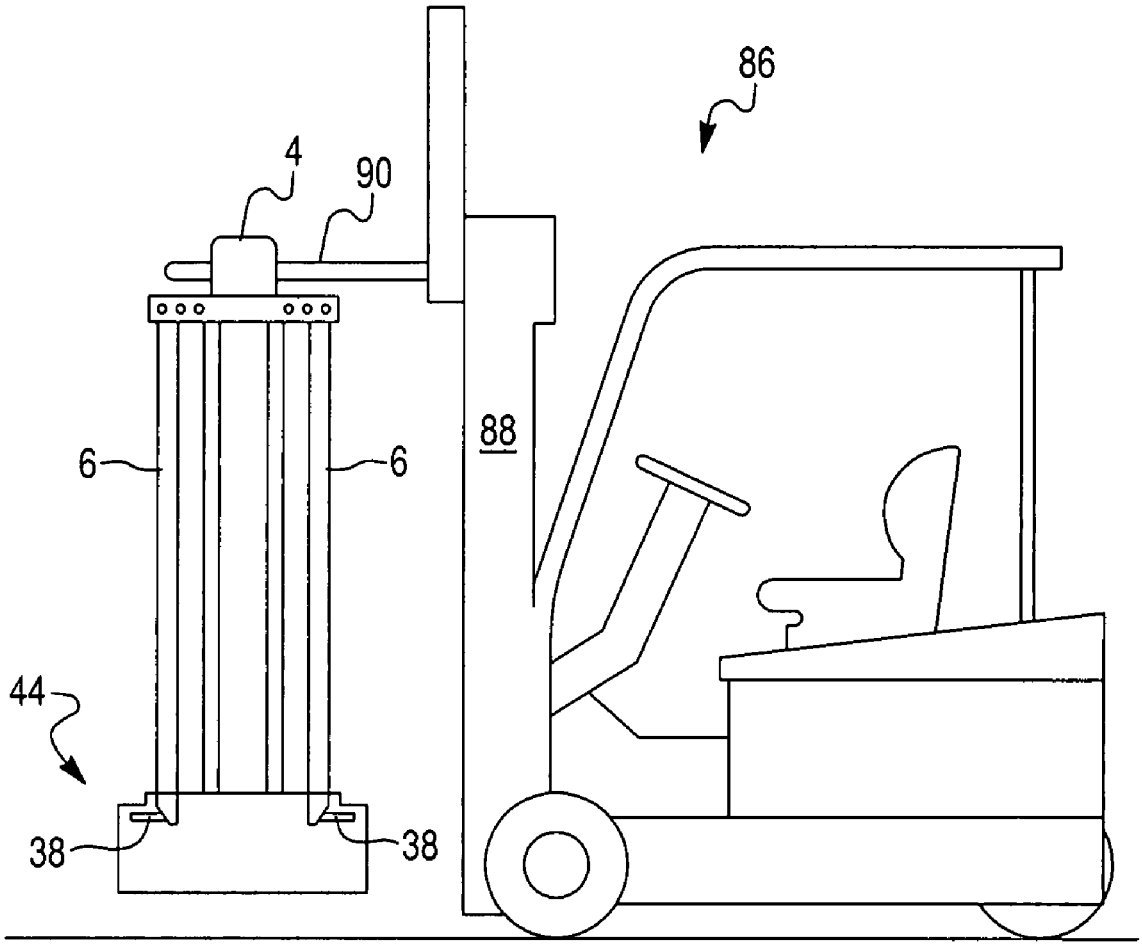
FIG. 6 illustrates a forklift including the lifting apparatus of the present invention.

The attachment part 4 includes an opening 5 through which a fork of a forklift can be insertably disposed. In this manner, the lifting apparatus 2 can be suspended from the forklift, as best shown in FIG. 6.

Figure 3A:
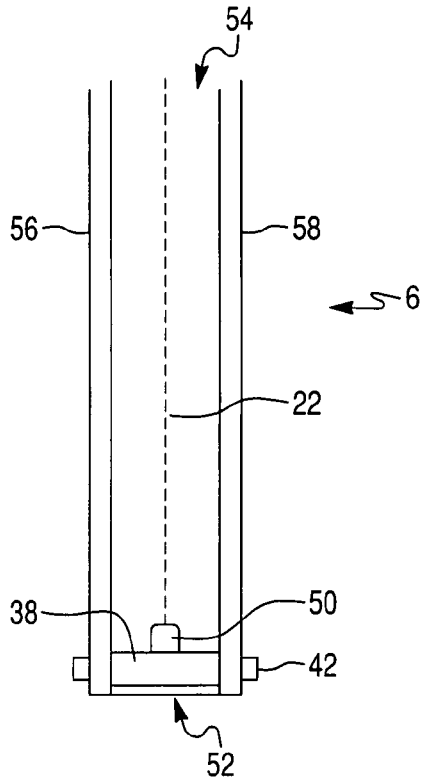
FIG. 3A is a fragmentary front elevational view of an elongated leg of the lifting apparatus of FIG. 1.

As best shown in FIG. 3A, each of the elongated legs 6 includes elongated leg plates 56 and 58 which form a slit 54 therebetween. Each support rod 38 is pivotably connected to the associated elongated leg 6 by a bolt 42. Thus, the support rod 38 can be freely pivoted around the associated bolt 42 in and out of the slit 54. While we prefer the use of four legs 6, it will be appreciated that a greater or fewer number of legs 6 may be used.

Figure 2A:
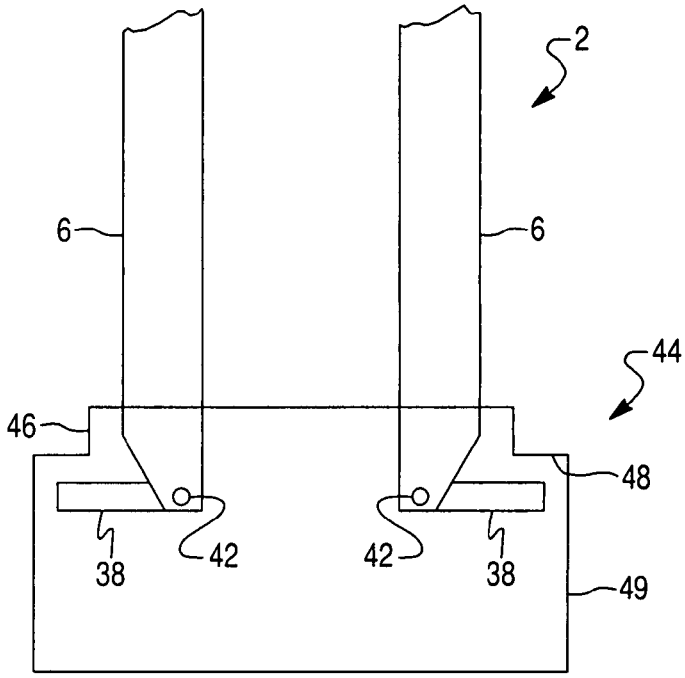
FIG. 2A is a fragmentary side elevational view of the lifting apparatus of FIG. 1 positioned inside a manufacturing ring.
Figure 3B:
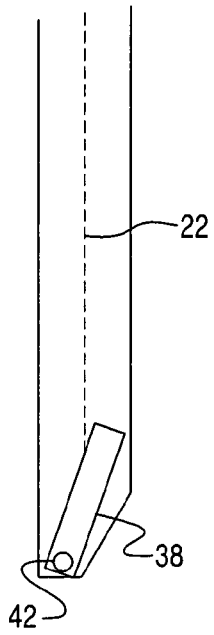
FIG. 3B is a fragmentary side elevational view of the elongated leg of the lifting apparatus of FIG. 1.

Each support rod 38 is disposed at the bottom of the slit 54 of the corresponding elongated leg 6 and is movable between a lowered position best shown in FIGS. 1, 2A, and 3A and a raised position best shown in FIG. 3B. In the lowered position shown in FIGS. 1, 2A, and 3A, the support rod 38 extends outwardly from the corresponding elongated leg 6 in a substantially horizontal direction.

As best shown in FIG. 3A, a steel plate 52 disposed below the support rod 38 is welded to the elongated leg plates 56 and 58. Plate 52 extends across the slit 54, maintains the spacing of plates 56 and 58, and limits downward motion of the support rod 38. The plate 52 supports the support rod 38 when the support rod 38 is in the horizontal orientation shown in FIG. 3A and prevents the support rod 38 from pivoting downwardly beyond the horizontal axis.

As best shown in FIG. 1, the plurality of elongated legs 6 define an open area therebetween. Center shaft 10 extends from the attachment part 4 within the open area. The center shaft 10 supports the actuating part 12 and the width adjusting part 24.

Figure 2B:
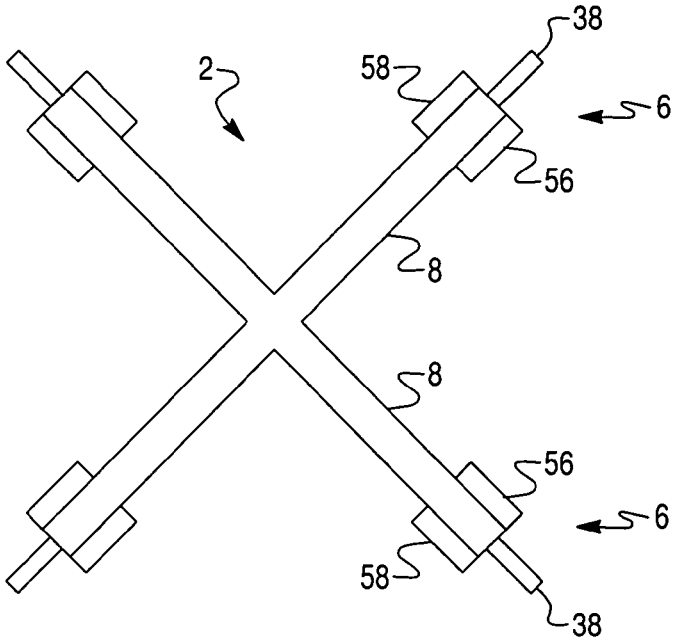
FIG. 2B is a partial top plan view of the lifting apparatus of FIG. 1.

As best shown in FIG. 2B, the lifting apparatus 2 includes two perpendicular upper support plates 8, each having the elongated legs 6 disposed at opposite ends thereof. The elongated, spaced apart leg plates 56 and 58 of the legs 6 are disposed on opposite sides of the upper support plates 8. The elongated legs 6 can be positioned along the upper support plates 8 in different positions. To this end, as best shown in FIG. 1, the upper support plates 8 have a plurality of leg setting holes 34 to which the elongated leg plates 56 and 58 can be attached, such as by bolts. The support plates 8 each have the same length in order to allow the legs 6 to be uniformly spaced relative to each other.

As best shown in FIG. 1, the actuating part 12 includes a guide 18 movably disposed on the center shaft 10. A plurality of steel cables 22 extend between the movable guide 18 and the support rods 38. The movable guide 18 preferably has a tubular shape. The cables 22 are represented in FIG. 1 by solid lines extending from the movable guide 18 which become dashed lines when the cables 22 are disposed in the slits 54 of the elongated legs 6. Based on the position of the movable guide 18 along the center shaft 10, the support rods 38 may be pivoted between the lowered position shown in FIGS. 1, 2A, and 3A and the raised position shown in FIG. 3B.

The cables 22 are connected to the movable guide 18 via connection pieces 16 disposed around the movable guide 18. The cables 22 may be tied or fastened to the connection pieces 16 in any manner known in the art. For example, the connection pieces 16 may be loops formed on the movable guide 18, and the cables 22 may be clamped to the connection pieces 16 to form a secure coupling between the support rods 38 and the movable guide 18. In a similar manner and as shown in FIG. 3A, the cables 22 are connected to the corresponding support rods 38 via support rod coupling parts 50 disposed on the support rods 38. The support rod coupling parts 50 may be loops formed on an upper portion of the supporting rods 38. The cables 22 may be connected to middle portions of the support rods 38 to provide the appropriate amount of angular displacement using the motion of the movable guide 18.

A handle 14 is associated with the guide 18 via a push/pull toggle bolt 20 such that the handle 14 can be displaced upwardly or downwardly, thereby moving the guide 18 and pivoting the support rods 38 in the corresponding elongated legs 6. When the handle 14 is in the upper position, the guide 18 is moved upwardly along the center shaft 10 to pivot the support rods 38 into the slits 54 of the corresponding elongated legs 6. Likewise, when the handle 14 is in the lowered position, the guide 18 is moved downwardly along the center shaft 10 to pivot the support rods 38 out of the slits 54 of the corresponding elongated legs 6 into the substantially horizontal position. The toggle bolt 20 locks the guide 18 in position on the center shaft 10. The toggle bolt 20 may be a push/pull toggle bolt available from MCMASTER-CARR®, for example, toggle bolt number 5093A39.

It should be understood that other embodiments of the present invention may use electromechanical solenoids or the like to move the guide 18 upward or downward along the center shaft 10.

As best shown in FIG. 1, the width adjusting part 24 of the lifting apparatus 2 includes shaft setting holes 30 disposed along the center shaft 10, an adjustable tubular base 28 disposed on the center shaft 10, an L-shaped handle 26, leg spacing plates 32 extending from the adjustable base 28 to the elongated legs 6, and a pin 31 removably insertable in the adjustable base 28 and a selected one of the shaft setting holes 30. The width adjusting part 24 cooperates with the leg setting holes 34 disposed on the upper support plates 8. Bolts 40 are carried by the adjustable base 28 and bolts 36 are carried by the elongated legs 6.

Figure 4A:
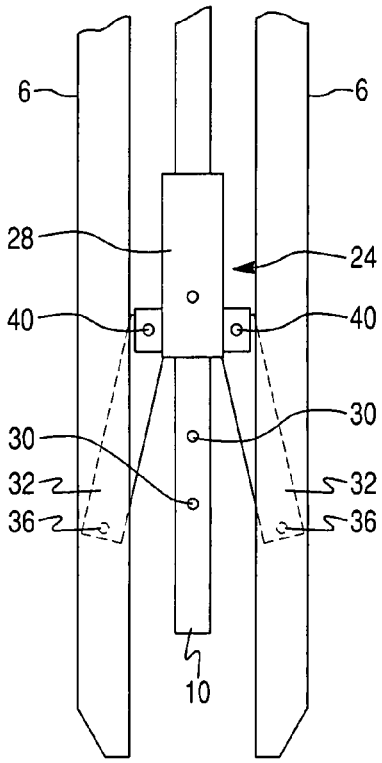
FIGS. 4A and 4B are fragmentary side elevational views of a width adjusting part of the lifting apparatus of FIG. 1.
Figure 4B:
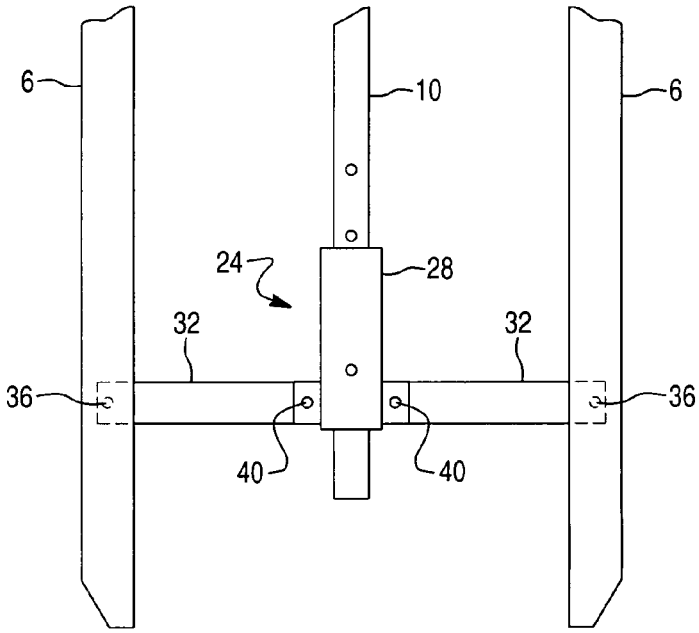

As best shown by a comparison of FIGS. 4A and 4B, the width adjusting part 24 is used to adjust the spacing between the elongated legs 6 so that the lifting apparatus 2 can be used with manufacturing rings of a variety of different sizes. The spacing between the elongated legs 6 defines the distance between distal ends of the support rods 38 disposed on opposite elongated legs 6. Thus, the distance between the distal ends of the support rods 38 can be varied to match the diameter of the manufacturing ring 44 by adjusting the spacing between the elongated legs 6.

As best shown in FIG. 1, the leg setting holes 34 are arranged along the upper support plates 8. The elongated legs 6 are fixed to the upper support plates 8 by bolts and nuts using these leg setting holes 34. Each upper support plate 8 includes a plurality of the leg setting holes 34 such that the position of the elongated legs 6 can be adjusted to create a desired upper spacing between the elongated legs 6.

The adjustable base 28 can be releasably coupled at different settings along the center shaft 10 using the pin 31 and the shaft setting holes 30. The pin 31 may be a bolt that is insertable in the shaft setting holes 30. Although not shown, the adjustable base 28 includes a hole through which the pin 31 extends to engage a selected one of the shaft setting holes 30 in the center shaft 10. Removal of the pin 31 allows the base 28 to be moved. The handle 26 provides a stable grip for a user to manually move the adjustable base 28. After base 28 has been aligned with the appropriate hole 30, the pin 31 is reinserted to thereby lock the base 28 in position. The adjustable base 28 may have a tubular shape that is guided along the center shaft 10.

The leg spacing plates 32 are pivotably connected to the adjustable base 28 at first ends thereof. Second ends of the leg spacing plates 32 are connected to the corresponding elongated legs 6 by the bolts 36. The leg spacing plates 32 are pivotable via the bolts 40 based on the position of the adjustable base 28 with respect to the center shaft 10. Because the leg spacing plates 32 are fixed on the elongated legs 6 and the base 28 by bolts 36 and 40, respectively, leg spacing plates 32 maintain a predetermined distance between the bolts 36 and 40. When the base 28 is moved along the center shaft 10, the leg spacing plates 32 pivot on the respective bolts 36 and 40 and thereby move the legs 6 inwardly or outwardly relative to center shaft 10 in order to space the legs 6 to accommodate the diameter of the manufacturing ring 44.

As best shown in FIG. 4A, when the adjustable base 28 is in an upper position on the center shaft 10, the leg spacing plates 32 extend angularly to the elongated legs 6 and space the elongated legs 6 apart. On the other hand, as best shown in FIG. 4B, when the adjustable base 28 is moved to the lowermost position on the center shaft 10, the leg spacing plates 32 are pivoted about the bolts 40 to force the elongated legs 6 outward to increase the space therebetween. Accordingly, the positioning of the adjustable base 28 along the center shaft 10 adjusts the spacing between the elongated legs 6.

Based on the movement and setting of the adjustable base 28 according to the shaft setting holes 30 along the center shaft 10 and the positioning of the elongated legs 6 at the various leg setting holes 34 along the upper support plates 8, the width/spacing of the lifting apparatus 2 can be adjusted to accommodate a manufacturing ring 44.

Should the lifting apparatus 2 be consistently used with manufacturing rings 44 of a predetermined size, the width adjusting part 24 may not be necessary.

Referring back to FIG. 2A, the manufacturing ring 44 includes an upper lip portion 46, a horizontal portion 48, and a lower main portion 49. As best shown in FIG. 2A, by virtue of the spacing of legs 6, the support rods 38 extend outwardly a distance that is larger than the diameter of the lip portion 46 of the manufacturing ring 44 and smaller than the diameter of the main portion 49 of the manufacturing ring 44. Accordingly, when the elongated legs 6 are lifted upwardly, the support rods 38 engage the horizontal portion 48 inside the manufacturing ring 44, thereby allowing the manufacturing ring 44 to be lifted.

Due to the fact that the support rods 38 are able to pivot upwardly via the bolts 42, the support rods 38 move upwardly upon contact with the lip portion 46 of the manufacturing ring 44 as the elongated legs 6 are being inserted within the manufacturing ring 44. Once the distal ends of the support rods 38 pass beyond the horizontal portion 48, the support rods 38 pivot downwardly in the main portion 49 to the substantially horizontal position shown in FIG. 2A due to the force of gravity. Downward pivoting of the support rods 38 is limited by the plates 52 of the corresponding elongated legs 6 so that the support rods 38 are prevented from pivoting beyond the substantially horizontal position, as best shown in FIG. 3A. The manufacturing ring 44 can then be lifted by moving the lifting apparatus 2 upwardly.

As best shown in FIG. 2B, the two perpendicular upper support plates 8 form an X-shaped configuration having sets of elongated legs 6 disposed at opposite ends of each support plate 8. The distance between the elongated legs 6 disposed at opposite ends of each support plate 8 may be set in cooperation with the width adjusting part 24 to about ¼ of an inch less than the diameter of the lip portion 46 of the manufacturing ring 44.

Figure 5A:
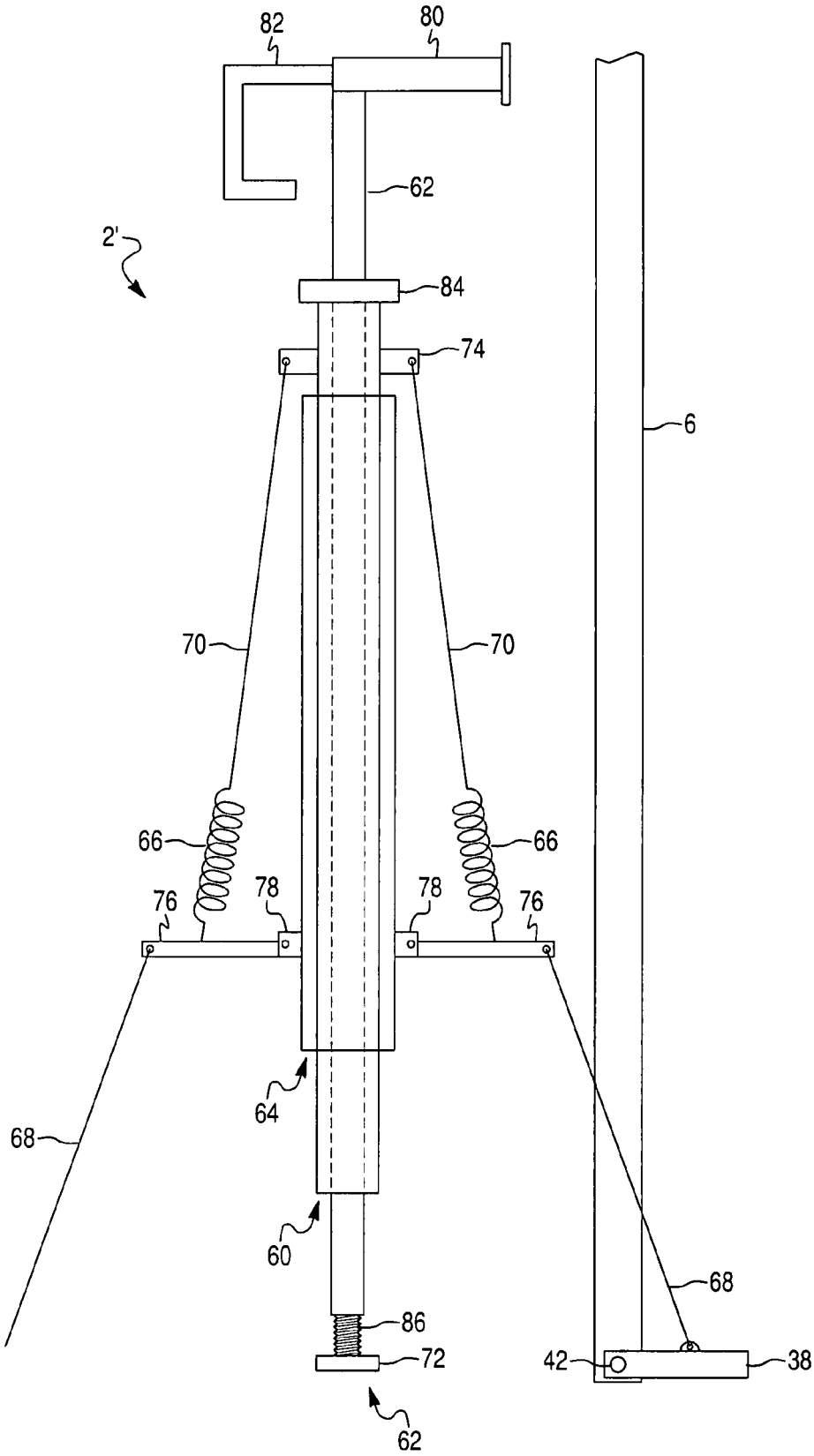
FIGS. 5A and 5B are fragmentary side views of a manufacturing ring lifting apparatus according to another embodiment of the present invention.

As best shown in FIG. 5A, the lifting apparatus 2' includes a guide tube 64, an actuating tube 60 disposed in the guide tube 64, and a timing shaft 62 disposed in the actuating tube 60. The timing shaft 62 includes a stop 72 disposed at an end thereof to contact the ground during operation. The timing shaft 62 also includes a threaded rod 86 allowing the length of the timing shaft 62 to be adjusted.

The lifting apparatus 2' further includes the elongated legs 6 with the support rods 38 and the bolts 42 about which the support rods 38 are pivoted. These elements of the lifting apparatus 2' are similar to the elements described above with reference to lifting apparatus 2 so that a detailed description thereof will not be provided here. Additionally, it should be understood that some of the elongated legs 6 and corresponding support rods 38 of the lifting apparatus 2' have been omitted from FIGS. 5A and 5B for illustration purposes. However, it should be noted that the lifting apparatus 2' includes a plurality of elongated legs 6 as with lifting apparatus 2. Additionally, the attachment part 4 is also not shown in FIGS. 5A and 5B.

As best shown in FIG. 5A, the lifting apparatus 2' includes lower cables 68 connected between the support rods 38 and cable supports 76 which are pivotably attached to the guide tube 64 via struts 78 and bolts 79. The lower cables 68 are coupled to ends of the cable supports 76 so as to pivot the support rods 38 in response to pivoting movements of the cable supports 76.

The cable supports 76 have springs 66 connected thereto and upper cables 70 connected to the springs 66. The springs 66 are connected at middle portions of the cable supports 76. The upper cables 70 are connected to a cable support 74 disposed near an upper portion of the actuating tube 60. Based on this configuration, movement of the actuating tube 60 with respect to the guide tube 64 causes the cable supports 76 to pivot, thereby moving the support rods 38 in and out of the slits 54 (not shown in FIGS. 5A and 5B) of the corresponding elongated legs 6.

Just above the cable support 74 on the actuating tube 60, an actuating tube engaging part 84 is arranged to engage a movable support 82 disposed near the top of the timing shaft 62 of the lifting apparatus 2'. The actuating tube engaging part 84 may be a T-shaped block, and the movable support 82 may be a complimentary collar-shaped block for engaging the T-shaped actuating tube engaging part 84 when moved into the appropriate position. The support 82 is horizontally movable within a tubular guide 80 disposed on the timing shaft 62. The timing shaft 62 extends through the actuating tube 60 and is connected to the movable support 82 so that the movable support 82 is moved up and down based on whether the stop 72 is pushed against the ground or is lifted from the ground.

The lifting apparatus 2' can be switched between the manufacturing ring lifting mode and the manufacturing ring releasing mode by releasing the actuating tube engaging part 84 from the movable support 82 or coupling the actuating tube engaging part 84 to the movable support 82, respectively.

Figure 5B:
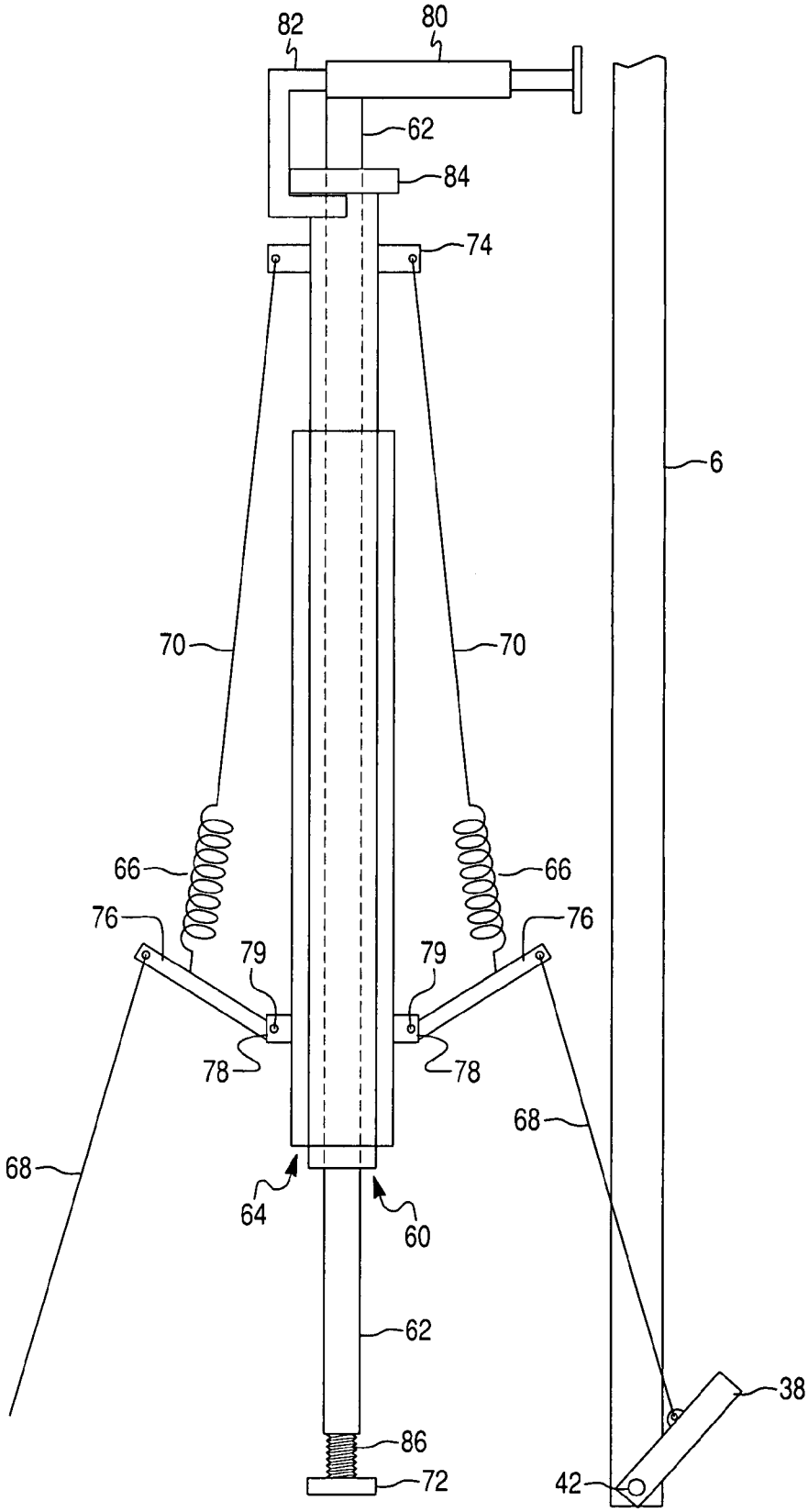

When the T-shaped actuating tube engaging part 84 is positioned in the collar-shaped movable support 82, the timing shaft 62 supports the actuating tube 60 so that the two are fixed together as shown in FIG. 5B. In this state, the actuating tube 60 is movable up and down along with the timing shaft 62 based on contact between the stop 72 and the ground. Also, in this state, the cable supports 76 are biased upwardly.

When the T-shaped actuating tube engaging part 84 is not positioned in the collar shaped movable support 82, the timing shaft 62 is movable within the actuating tube 60 as shown in FIG. 5A. In this state, the timing shaft 62 is movable up and down based on contact between the stop 72 and the ground, while the actuating tube 60 and the guide tube 64 remain in substantially the same position. Also, in this state, the cable supports 76 remain in the horizontal position.

It should be noted that although the movable support 82 and the actuating tube engaging part 84 are shown and described with reference to FIGS. 5A and 5B as the collar shaped block and the T-shaped block, respectively, other mechanisms for engaging the actuating tube 60 with the top portion of the timing shaft 62 may be employed. For example, a pin (not shown) may alternatively be used to set the actuating tube 60 and the timing shaft 62 together in the position shown in FIG. 5B.

As best shown in FIG. 5A, when the lifting apparatus 2' is in the manufacturing ring lifting mode, the actuating tube 60 is not attached to the movable support 82. In this mode, the timing shaft 62 is movable with respect to the guide tube 64 and actuating tube 60 such that when the stop 72 contacts the ground and pushes the timing shaft 62 upward, the guide tube 64 and the actuating tube 60 remain in substantially the same position. Thus the upper cables 70 and the springs 66 do not apply an upward force to the corresponding cable supports 76. As a result, the cable supports 76 remain substantially horizontal so that the support rods 38 to extend horizontally from the elongated legs 6. The elongated legs 6 can be inserted into the manufacturing ring 44 so that the support rods 38 engage and support the manufacturing ring 44 for lifting and handling.

The lifting apparatus 2' and the lifting apparatus 2 can be used repeatedly to lift more than one manufacturing ring 44 and can create a stack of manufacturing rings 44. More particularly, the elongated legs 6 may be repeatedly inserted into a manufacturing ring 44 and lifted in the same manner as the lifting apparatus 2 of FIG. 1. Hence, a stack of manufacturing rings 44 can be lifted by positioning a first manufacturing ring 44 supported by the lifting apparatus 2' on a second manufacturing ring 44 and lifting the first and second manufacturing rings 44 together. Alternatively, a stack of the manufacturing rings 44 can be lifted by inserting the elongated legs 6 in a stack of the manufacturing rings 44 and lifting.

As best shown in FIG. 5B, when the lifting apparatus 2' is in the manufacturing ring releasing mode, the actuating tube 60 is attached to the movable support 82 by the actuating tube engaging part 84. The upper cables 70 and the springs 66 apply an upward force to the corresponding cable supports 76.

The timing shaft 62 and the actuating tube 60 are movable together in the guide tube 64. The timing shaft 62 extends through the actuating tube 60 and is connected to the movable support 82 such that the movable support 82 is also moved up or down with the timing shaft 62. When the stop 72 of the timing shaft 62 contacts the ground and pushes the timing shaft 62 and the actuating tube 60 upward in the guide tube 64, the upward motion pulls the cable supports 76 via the upper cables 70 and the springs 66 upwardly to pivot the support rods 38 inwardly. In turn, the support rods 38 are pulled into the slits 54 (not shown in FIG. 5B) of the corresponding elongated legs 6.

Then, as the lifting apparatus 2' is lifted from the ground, the timing shaft 62 and the actuating tube 60 are gradually allowed to move downwardly with respect to the guide tube 64 due to gravity until the cable supports 76 are pivoted downwardly by the upper cables 70 and the springs 66 to a substantially horizontal position to allow the lower cables 68 to pivot the support rods 38 outward.

The springs 66 provide a preload to account for inconsistencies in the surface of the ground. As best shown in FIG. 5B, the springs 66 provide some flexibility to the controlled motion of the cable supports 76 in the event that the stop 72 contacts a hole or bump in the ground.

The length of the timing shaft 62 is selected such that the downward pivoting motion of the cable supports 76 occurs after the lifting apparatus 2' has been raised a predetermined height from the ground and the actuating tube 60 and the timing shaft 62 are allowed to move downwardly by this predetermined height. Thus, the timing shaft 62 "times" the downward pivoting motion of the cable supports 76.

The manufacturing ring release mode shown in FIG. 5B can be used to release a stack of manufacturing rings 44 supported by the lifting apparatus 2', one by one. The support rods 38 are controlled by the upward motion of the timing shaft 62 and the actuating tube 60 within the guide tube 64 to pivot upwardly and release the lowermost manufacturing ring 44 in a stack. Then, as the stop 72 is moved upwardly off the ground, the timing shaft 62 and the actuating tube 60 are allowed to move downwardly together with respect to the guide tube 64 due to gravity such that the stop 72 remains in contact with the ground and until the cable supports 76 pivot downward. The downward motion of the timing shaft 62 and the actuating tube 60 within the guide tube 64 cause the support rods 38 to pivot and engage the next manufacturing ring 44 in the stack only after the support rods 38 have passed through the lip portion 46 of the lowermost manufacturing ring 44. The next lowermost manufacturing ring 44 can be released in the same manner.

The threaded rod 86 is used to adjust the length of the timing shaft 62. When the length of the timing shaft 62 is changed using the rod 86, the timing of the pivoting motion of the cable supports 76 is also changed. Thus, the "timing" and operation of the timing shaft 62 can be modified to suit the height of the manufacturing rings 44 being lifted and handled.

It should be understood that other embodiments of the present invention may use electromechanical solenoids or the like to move the cable supports 76 downward based on the movement of the timing shaft 62.

Additionally, although the embodiment of FIGS. 5A and 5B show and describe that the lifting apparatus 2' as including the upper and lower cables 70 and 68 with the cable supports 76 disposed therebetween, alternatively, it is possible that in other embodiments the lifting apparatus 2' may include cables extending directly between the cable support 74 and the support rods 38.

As best shown in FIG. 6, a forklift 86 has a vertical mast 88 with a movable fork 90 that can be moved horizontally and vertically. The lifting apparatus 2 or 2' is disposed on the fork 90 using the attachment part 4, which is best shown in FIG. 1. The elongated legs 6 extend downwardly into the manufacturing ring 44 such that the support rods 38 engage the horizontal engaging surface 48 of the manufacturing ring 44 shown in FIG. 2A. Accordingly, the manufacturing ring 44 may be lifted and handled by moving the fork 90 up and down.

A method of lifting manufacturing rings 44 using the lifting apparatus 2 of FIG. 1 will now be described with reference to FIGS. 1 through 4 and 6. The method includes setting the support rods 38 in the lowered position using the actuating part 12 of the lifting apparatus 2 shown in FIG. 1. Specifically, the handle 14 is moved downwardly to move the guide 18 downwardly along the center shaft 10. In turn, the cables 22 are moved downwardly so that the support rods 38 pivot out of the corresponding slits 54 in the elongated legs 6 to the substantially horizontal position.

Next, the elongated legs 6 of the lifting apparatus 2 are inserted into the annular manufacturing ring 44. The elongated legs 6 of the lifting apparatus 2 are moved downwardly in the manufacturing ring 44 such that the distal ends of the support rods 38 contact the inner wall of the lip portion 46 of the manufacturing ring 44 and are forced upwardly. When the elongated legs 6 move beyond the horizontal portion 48, the support rods 38 pivot downwardly in the manufacturing ring 44 due to gravity.

The elongated legs 6 of the lifting apparatus 2 may then be moved upwardly so that the horizontally operated support rods 38 engage the horizontal portion 48 of the manufacturing ring 44, thereby lifting the manufacturing ring 44.

It should be understood that the lifting apparatus 2 can be used to lift a stack of manufacturing rings 44 at any given time by repeating the steps described above. In this case, the lifting apparatus 2 lifts a first manufacturing ring 44 and positions the first manufacturing ring 44 on top of a second manufacturing ring 44 so that the elongated legs 6 move the support rods 38 into a lifting position in the second manufacturing ring 44, which is disposed below the first manufacturing ring 44. Thus, when the second manufacturing ring 44 is lifted by the lifting apparatus 2, the first manufacturing ring 44 is lifted with it in a stacked configuration.

In order to set the manufacturing ring(s) 44 down, the elongated legs 6 are moved downwardly such that the support rods 38 do not contact the horizontal portion 48. Then, the handle 14 is moved upwardly to move the guide 18 upwardly along the center shaft 10 of the lifting apparatus 2. As a result, the cables 22 pull the corresponding support rods 38 into the slits 54 of the corresponding elongated legs 6. The elongated legs 6 can then be lifted out of the annular opening(s) in the manufacturing ring(s) 44.

A method of lifting manufacturing rings 44 using the lifting apparatus 2' will now be described with reference to FIGS. 2A through 3B and 5A through 6.

The method includes setting the lifting apparatus 2' to the manufacturing ring lifting mode shown in FIG. 5A so that the support rods 38 are in the lowered position. This is achieved by releasing the actuating tube engaging part 84 from the movable support 82 of the timing shaft 62. In the manufacturing ring lifting mode, the support rods 38 of the lifting apparatus 2' function to lift the manufacturing ring(s) 44 in a manner similar to the lifting apparatus 2 described above.

Once one or more of the manufacturing rings 44 or a stack of the manufacturing rings 44 are supported by the support rods 38 of the lifting apparatus 2', the lifting apparatus 2' can be set to the manufacturing ring releasing mode for releasing the manufacturing rings 44 from the stack, one by one, beginning with the lowermost manufacturing ring 44 in the stack. The lifting apparatus 2' is set to the manufacturing ring releasing mode by engaging the actuating tube engaging part 84 with the movable support 82 such that the upper cables 70 and the springs 66 apply an upward force to the cable supports 76.

Then the lifting apparatus 2' is lowered so that the stop 72 of the timing shaft 62 contacts the ground in the manufacturing ring 44 and pushes the timing shaft 62 and the actuating tube 60 upward in the guide tube 64 such that the upward motion pulls the cable supports 76 via the upper cables 70 and the springs 66 upward to pivot the support rods 38 inward. The lifting apparatus 2' is then moved upward so that the timing shaft 62 and the actuating tube 60 are gradually allowed to move downward in the guide tube 64 due to gravity until the support rods 38 pivot outward.

By the time the support rods 38 are allowed to pivot downwardly into the substantially horizontal position, the lowermost manufacturing ring 44 has been released and the support rods 38 are disposed in the next manufacturing ring 44. The next manufacturing ring 44 along with any other manufacturing rings 44 disposed thereon are then lifted from the lowermost manufacturing ring 44 as the lifting apparatus 2 is moved upward. In this manner, one manufacturing ring 44 in a stack of manufacturing rings 44 can be released each time the lifting apparatus 2 is lowered to the ground.

Although the present invention has been described with reference to manufacturing rings, it should be understood that the present invention is not intended to be limited in this respect. The present invention may be used to lift other large tubular structures employed in other building structures and applications.

The lifting apparatus of the embodiments of the present invention can be used with a forklift to safely and easily handle manufacturing rings so that the manufacturing rings need not be lifted by hand.

Furthermore, the lifting apparatus can lift a plurality of manufacturing rings in a stacked configuration at a given time thereby increasing efficiency.

The lifting apparatus of an embodiment of the present invention has a width that is adjustable and can be used with manufacturing rings of various different shapes and sizes.

Additionally, the lifting apparatus of another embodiment of the invention can release manufacturing rings in a stacked configuration, one by one, such that the manufacturing rings can be placed in different locations.

Although embodiments of the present invention have been shown and described, it will be appreciated by those skilled in the art that changes may be made in these embodiments without departing from the principles and spirit of the invention, the scope of which is defined in the appended claims and their equivalents.

We claim:

1. A lifting apparatus for lifting manufacturing rings, the apparatus comprising:

an attachment part;

a plurality of elongated legs extending from said attachment part, each of said elongated legs having a slit disposed therein;

a plurality of support rods, each support rod associated with one of said legs and movably disposed in the associated slit, said support rods being pivotable between a lowered position in which each support rod extends from the associated slit and a raised position in which each support rod is upwardly disposed;

an actuating part operably associated with said support rods, said actuating part for moving said support rods between the raised position and the lowered position;

a plurality of upper support plates disposed below said attachment part and supporting said elongated legs;

a center shaft extending from said upper support plates between said elongated legs; and a width adjusting part carried by said center shaft to adjust spacing between said elongated legs, wherein said width adjusting part comprises a base adjustable along said center shaft and a plurality of leg spacing plates extending from said base and fixed to corresponding elongated legs, and wherein the spacing between said elongated legs is adjusted based on the position of said base along said center shaft.

2. The lifting apparatus of claim 1, further comprising:

a guide disposed on said center shaft and movable between an upper position and a lower position; and a plurality of cables extending between said guide and said support rods so that said support rods may pivot between the lowered position and the raised position.

3. The lifting apparatus of claim 1, wherein each of said support rods is supported at a bottom end of the associated slit by a bolt extending across the associated slit, the support rod being pivotably disposed around the associated bolt.

4. The lifting apparatus of claim 1, wherein said width adjusting part further comprises:

a plurality of setting holes disposed along said center shaft; and a pin removably disposed in said base to engage a selected one of said setting holes on said center shaft.

5. The lifting apparatus of claim 4, wherein said width adjusting part further comprises:

a plurality of leg setting holes disposed along said upper support plates, said leg setting holes for enabling the positions where said elongated legs are attached to said upper support plates to be adjusted; and a plurality of support plate pivoting parts for pivotably connecting said leg spacing plates to said base so that said leg spacing plates are oriented horizontally with respect to said elongated legs to maximize the spacing therebetween or diagonally with respect to said elongated legs to minimize the spacing therebetween.

6. The lifting apparatus of claim 1, wherein each of said slits in the associated elongated legs comprises a rod limiting part disposed at a bottom portion thereof that prevents said support rods from pivoting downwardly beyond a substantially horizontal position.

7. The lifting apparatus of claim 1, wherein said plurality of upper support comprises first and second upper support plates disposed below said attachment part, said first and second upper support plates crossing each other to form an X-shaped configuration, wherein said elongated legs are disposed at opposite ends of said first and second support plates.

8. The lifting apparatus of claim 7, wherein each of said elongated legs comprises:

first and second elongated leg plates connected on opposite sides of the associated upper support plate; and a bottom plate welded to the first and second elongated leg plates at a bottom portion of the associated elongated leg.

9. The lifting apparatus of claim 1, wherein said actuating part comprises:

a guide tube;

an actuating shaft disposed within said guide tube, said actuating shaft having a cable fixing part disposed at an upper portion thereof and having a lower portion extending from said guide tube for contacting a surface; and a plurality of cables extending between said cable fixing part and said support rods so that movement of said actuating shaft causes said cables to pivot said support rods.

10. The lifting apparatus of claim 1, wherein said actuating part comprises:

a guide tube having a plurality of cable supports pivotably connected thereto;

a plurality of lower cables connected between said cable supports and said support rods;

an actuating shaft disposed within said guide tube, said actuating shaft having a cable fixing part disposed at an upper portion thereof and having a lower portion extending from said guide tube for contacting a surface; and a plurality of upper cables connected between said cable fixing part and said cable supports.

11. The lifting apparatus of claim 10, wherein said actuating shaft has an adjustable length.

12. The lifting apparatus of claim 10, wherein contact between a lower end of said actuating shaft and a surface causes said cable supports to pivot.

13. The lifting apparatus of claim 10, wherein said actuating shaft comprises:

an actuating tube movably disposed in said guide tube and having said cable fixing part disposed at an upper portion thereof; and a timing shaft disposed in said actuating tube, said timing shaft including a contact stop disposed at a lower end thereof to contact the ground and a support part disposed at an upper end thereof, said support part for engaging said actuating tube to suspend said actuating tube in a fixed upper position with respect to said timing shaft so that an upward force is applied on said upper cables and said lower cables to pivot said support rods upward when said stop is disposed on the ground.

14. The lifting apparatus of claim 10, wherein said actuating part further comprises:

a plurality of springs disposed between said cable supports and said upper cables.

15. The lifting apparatus of claim 1, wherein said actuating part comprises:

an actuating tube having a cable fixing part disposed at an upper portion thereof and an engaging part disposed above said cable fixing part;

a plurality of cables extending between said cable fixing part and said support rods; and a timing shaft disposed in the actuating tube, said timing shaft having a stop disposed at a lower end thereof to contact a surface and a support disposed at an upper end thereof, wherein the actuating part is operable between a first mode in which the engaging part is supported by the support of the timing shaft so that the actuating tube and timing shaft are fixed and movable together, and a second mode in which the engaging part is not supported by the support of the timing shaft so that the timing shaft is movable within the actuating tube.

16. A forklift assembly, comprising:

a forklift having a vertical mast and a fork extending substantially horizontally from said mast; and a lifting apparatus for lifting manufacturing rings, said lifting apparatus including an attachment part having an opening through which said fork is disposed, a plurality of elongated legs extending from said attachment part, each of said elongated legs having a slit disposed therein, a plurality of support rods movably disposed in said slits, said support rods being pivotable between a lowered position in which each support rod extends from the associated slit and a raised position in which each support rod is disposed within the associated slit, and an actuating part operably associated with said support rods, said actuating part for moving said support rods between said raised position and said lowered position, wherein the actuating part comprises a guide tube having a plurality of cable supports pivotably connected thereto, a plurality of lower cables connected between said cable supports and said support rods, an actuating shaft disposed within said guide tube, said actuating shaft having a cable fixing part disposed at an upper portion thereof and having a lower portion extending from said guide tube for contacting a surface and a plurality of upper cables connected between said cable fixing part and said cable supports, and wherein the actuating shaft comprises an actuating tube movably disposed in said guide tube and having said cable fixing part disposed at an upper portion thereof, and a timing shaft disposed in said actuating tube, said timing shaft including a contact stop disposed at a lower end thereof to contact the ground and a support part disposed at an upper end thereof, said support part for engaging said actuating tube to suspend said actuating tube in a fixed upper position with respect to said timing shaft so that an upward force is applied on said upper cables and said lower cables to pivot said support rods upward when said stop is disposed on the ground.

17. A lifting apparatus for lifting manufacturing rings, the apparatus comprising:

an attachment part;

a plurality of elongated legs extending from said attachment part, each of said elongated legs having a slit disposed therein;

a plurality of support rods, each support rod associated with one of said legs and movably disposed in the associated slit, said support rods being pivotable between a lowered position in which each support rod extends from the associated slit and a raised position in which each support rod is upwardly disposed; and an actuating part operably associated with said support rods, said actuating part for moving said support rods between the raised position and the lowered position, wherein said actuating part comprises an actuating tube having a cable fixing part disposed at an upper portion thereof and an engaging part disposed above said cable fixing part, a plurality of cables extending between said cable fixing part and said support rods, and a timing shaft disposed in the actuating tube, said timing shaft having a stop disposed at a lower end thereof to contact a surface and a support disposed at an upper end thereof, the actuating part is operable between a first mode in which the engaging part is supported by the support of the timing shaft so that the actuating tube and timing shaft are fixed and movable together, and a second mode in which the engaging part is not supported by the support of the timing shaft so that the timing shaft is movable within the actuating tube.

18. The lifting apparatus of claim 17, further comprising:

a width adjusting part operably associated with said attachment part to adjust spacing between said elongated legs to accommodate manufacturing rings of different sizes.

19. The lifting apparatus of claim 18, further comprising:

a plurality of upper support plates disposed below said attachment part and supporting said elongated legs; and a center shaft extending from said upper support plates between said elongated legs.

20. The lifting apparatus of claim 18, wherein said width adjusting part further comprises:

a plurality of setting holes disposed along said center shaft; and a pin removably disposed in said base to engage a selected one of said setting holes on said center shaft.

* * * * *